US005680777A

United States Patent [19]

Zorini

[11] Patent Number: 5,680,777

[45] Date of Patent: Oct. 28, 1997

[54] DEVICE FOR INSERTING ALTERNATELY-INTERPOSED WEFTS ON A CROCHET GALLOON MACHINE FOR WARP WEAVING, AND ARTICLE OF MANUFACTURE THUS OBTAINED

[76] Inventor: Luigi Omodeo Zorini, Via dei Mille, 71, Cilavegna (Pavia), Italy

[21] Appl. No.: 742,455

[22] Filed: Nov. 1, 1996

[30] Foreign Application Priority Data

Oct. 3, 1996 [EP] European Pat. Off. ..... 96830507

[51] Int. Cl.[6] ..... D04B 23/12; D04B 23/22

[52] U.S. Cl. ..... 66/84 A; 66/85 R; 66/207

[58] Field of Search ..... 66/84 A, 85 R, 66/85 A, 207

[56] References Cited

U.S. PATENT DOCUMENTS

| | | | |
|---|---|---|---|
| 3,745,792 | 7/1973 | Bergmann | 66/84 A X |
| 4,136,534 | 1/1979 | Villa | 66/84 A |
| 4,444,025 | 4/1984 | Krueger | 66/84 A |
| 4,793,158 | 12/1988 | Liebrandt | 66/84 A |
| 4,873,844 | 10/1989 | Frenzel et al. | 66/84 A |
| 5,072,602 | 12/1991 | Naumann | 66/84 A |
| 5,111,672 | 5/1992 | Gille et al. | 66/84 A |

*Primary Examiner*—John J. Calvert

*Attorney, Agent, or Firm*—Laff, Whitesel, Conte & Saret, Ltd.

[57] ABSTRACT

Installed on a crochet galloon machine is a device (1) for inserting alternately-interposed wefts, comprising two weft-inserting sliders (10, 16) carrying respective threading tubes (11, 17) each adapted to lay down a weft yarn (12, 18) to be interlooped in the article of manufacture (M) being worked. Each slider (10, 16) is movable along a respective weft-inserting guide (9, 15). The cyclic movements of the sliders (10, 16) are mutually offset according to a cycle fraction equal to the number of the provided weft-inserting bars (9, 15), so as to alternate laying down of each weft yarn (10, 18) with each chain stitch (6*b*)-formation cycle.

9 Claims, 9 Drawing Sheets

DEVICE FOR INSERTING ALTERNATELY-INTERPOSED WEFTS ON A CROCHET GALLOON MACHINE FOR WARP WEAVING, AND ARTICLE OF MANUFACTURE THUS OBTAINED

BACKGROUND OF THE INVENTION

1. Field of the Invention

The present invention relates to a device for inserting alternately-interposed wefts on a crochet galloon machine for warp weaving, said machine having a plurality of needles carrying out a reciprocating motion in a rectilinear direction on a front bar and guide eye-pointed needles disposed before the needles and each moved in a circular trajectory extending about the movement trajectory of a corresponding needle, said device comprising at least one first weft-inserting guide extending horizontally above the needles at right angles to the movement direction of the needles themselves; at least one first weft-inserting slider slidably engaged along the weft-inserting guide and carrying at least one first threading tube arranged to engage at least one first weft yarn; at least one second weft-inserting guide (15) extending above the needles (5) parallelly to the first weft-inserting guide (9); at least one second weft-inserting slider (16) slidably engaged along the second weft-inserting guide (15) and carrying at least one second threading tube arranged to engage at least one second weft yarn; horizontal-movement means acting on the weft-inserting sliders to drive them with a reciprocating motion along the first weft-inserting guide bar; vertical-movement means to transmit a reciprocating oscillatory motion in a vertical direction to the weft-inserting sliders.

2. Prior Art

It is known that crochet galloon machines for warp weaving are essentially comprised of a plurality of needles disposed consecutively in side by side relation to form one or more rows respectively in alignment along a front bar, and driven with a reciprocating rectilinear motion in a longitudinal direction.

Disposed before the needles is a plurality of guide eye-pointed needles each provided with a respective warp yarn and substantially moved in a circular trajectory so that, during each work cycle, each warp yarn is crossed about a respective needle. When working is carried out, the cooperation between the needles and respective eye-pointed needle-gives rise to the formation of a plurality of chains that usually are mutually connected by the interlacing of weft yarns brought close to the needles by means of respective threading tubes oscillating in a trajectory extending astride one or more needles. The amount, arrangement and amplitude of movement of the threading tubes can widely vary depending on the selected type of equipment for the crochet galloon machine, in turn depending on the type of work to be carried out.

Among the different equipping possibilities of the crochet galloon machines for warp weaving there is that of mounting a weft-inserting device capable of laying down a weft yarn over the whole width of the workpiece even when this width has a relatively high value. Such a weft-inserting device essentially comprises a weft-inserting guide extending in a horizontal plane above the needles, at right angles to the direction of the reciprocating motion performed by said needles, and slidably engaging a weft-inserting runner or slider carrying at least one threading tube through which the weft yarn is engaged.

The weft-inserting device further comprises horizontal-movement means and vertical-movement means mutually cooperating so as to transmit a reciprocating motion extending astride the corresponding needle row to the threading tube.

Cooperation between the threading tube and the needles is such that, in the obtained article of manufacture, the weft yarn extends in consecutive parallel lengths, each length covering the whole width of the article of manufacture itself and interlacing all chains formed by the warp yarns. It is to point out however that at the present state of the art, the presence of the weft-inserting device can involve some problems in terms of productivity of the crochet galloon machine. In fact, in most cases, strokes carried out by the weft-inserting slider along the corresponding guide necessarily are of an important amplitude and, as a result, since the machine runs at high operating speeds, the slider must reach very high velocities. Under this situation, the concerned inertial masses tend to cause vibrations and overstresses to the different members of the kinematic driving mechanisms, which can be held within acceptable limits only by conveniently reducing the operating speed of the whole crochet galloon machine, which will bring about a lower productivity.

Another drastic limitation to the operating speed of the machine is imposed when the use of very weak and/or brittle weft yarns is required due to the type of production involved, as in particular in the case in which articles of manufacture made of fiber glass are produced which are used in making composite-material structures and the like.

In fact, due to the great brittleness of glass, the operating speed of the machine needs to be approximately halved as compared with the real production capacities, in order to prevent the weft yarn from being broken by effect of stresses imposed thereto when the threading tube reverses its motion.

SUMMARY OF THE INVENTION

In accordance with the present invention, the limits and drawbacks of the known art are brilliantly overcome by a device for inserting alternately-interposed wefts, provided with two or more sliders mounted on respective weft-inserting guides, wherein said vertical-movement means and horizontal-movement means act on said sliders to operate them with mutually offset periodical reciprocating motions the frequency of which, with respect to the movement frequency of the needles, is a fraction having as the denominator a value which is twice the overall number of said weft-inserting guides.

BRIEF DESCRIPTION OF THE DRAWINGS

Further features and advantages will become more apparent from the detailed description of a preferred embodiment of a device for inserting alternately-interposed wefts, mounted on a crochet galloon machine for warp weaving, in accordance with the present invention, taken hereinafter by way of non-limiting example with reference to the accompanying drawings, in which.

DESCRIPTION OF THE PREFERRED EMBODIMENT

Figure 1:
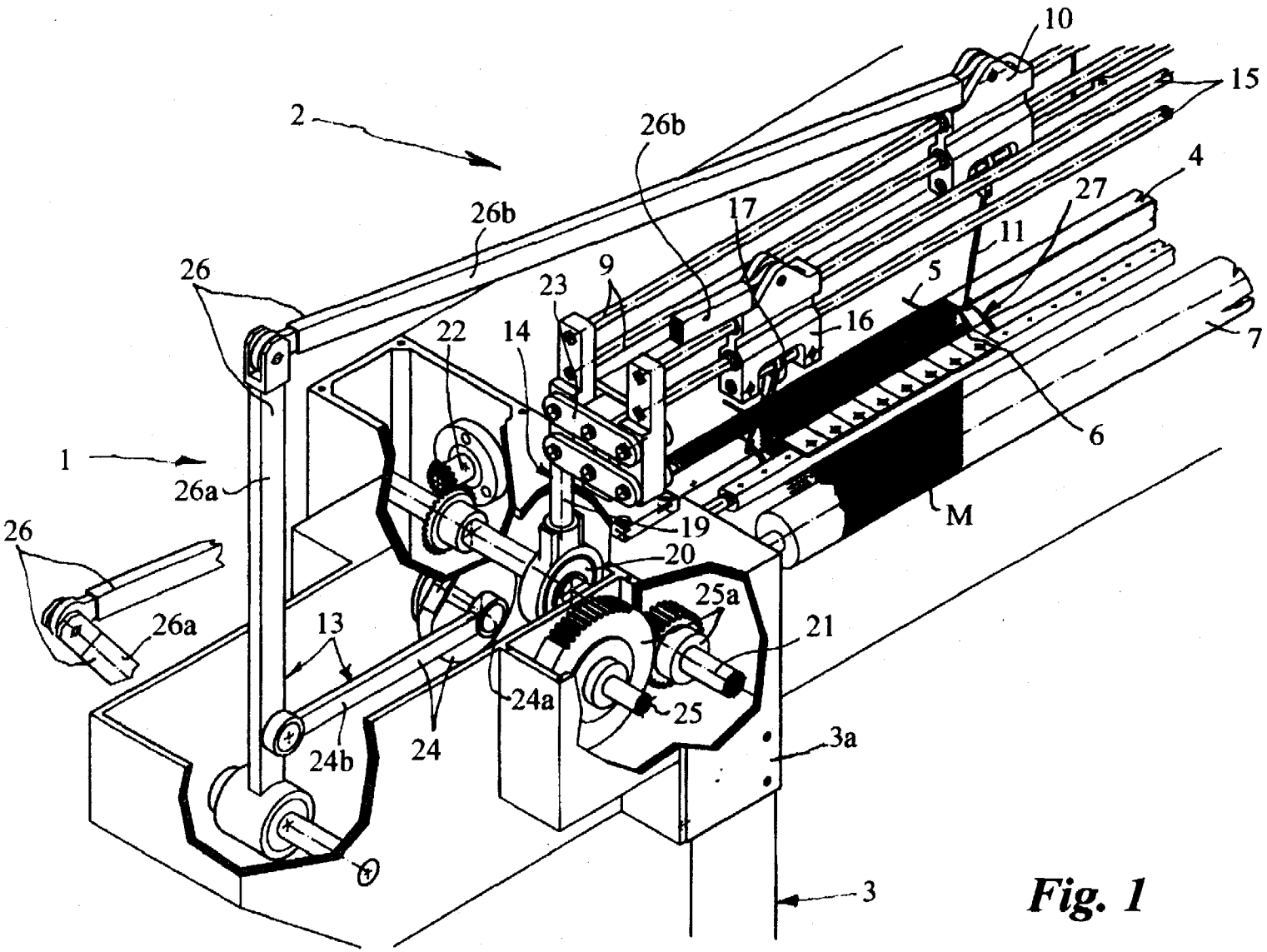
FIG. 1 is a fragmentary perspective view of a device according to the present invention, mounted on a crochet galloon machine.

With reference to the drawings, a device for inserting alternately-interposed wefts in accordance with the present invention has been generally identified by reference numeral 1.

The device 1 is associated with a crochet galloon machine, only partially shown in that known per se and conventional. This crochet galloon machine is essentially comprised of a bed 3 provided with two side standards 3*a* and 3*b* between which a front bar 4 horizontally extends. Located on the front bar 4 is a plurality of needles 5, disposed consecutively in side by side relation to form at least one row the amplitude of which corresponds to the width of the article of manufacture "M" to be made.

In a manner known per se, needles 5 are set in motion by a drive shaft 22, so as to be operated in a reciprocating manner in the direction of their longitudinal extension, above the front bar 4.

Needles 5 cooperate with a plurality of eye-pointed needles 6 located before the needles and operated in such a manner that each of them performs a circular trajectory about the movement direction of the respective needle 5, in synchronism with the movement of said needles. Under this situation, the warp yarns 6*a* carried by the eye-pointed needles 6 get cyclically in engagement with needles 5 so as to cause formation of chain stitches 6*b* that are gradually moved away from the needles themselves, upon the action of collecting rollers 7 acting on the workpiece M.

The foregoing being stated, the device 1 is adapted to cause, concurrently with each chain-stitch-formation cycle, laying of at least one weft yarn over the whole extension of the needle row, so that said weft yarn is interlooped in the chain-stitch loops 6*b* formed by the individual needles 5. To this end, the device 1 comprises a first weft-inserting guide 9 extending horizontally above the needles 5 at right angles to the movement direction of said needles. The first weft-inserting guide 9 slidably carries a first slider 10 to which at least one first threading tube 11 is connected, through which, in a manner known per se, a first weft yarn 12 supplied from a usual creel or other appropriate feeding means known per se, is engaged.

The first weft-inserting slider 10 is submitted to the action of horizontal-movement means 13 adapted to impart a reciprocating motion to it along the corresponding weft-inserting guide 9, covering a slightly greater extension than the amplitude of the row formed by needles 5 on the front bar 4. The horizontal-movement means 13 cooperate with vertical-movement means 14 adapted to impart a reciprocating oscillatory motion in a vertical direction to slider 10, the frequency of which is twice that of the reciprocating motion transmitted to the same slider by the horizontal-movement means 13. Due to the combination of the horizontal and vertical reciprocating oscillations, the threading tube 11, during each going or return stroke of its horizontal movement, covers a trajectory extending astride the whole row formed by needles 5.

The device 1 further comprises at least one second weft-inserting guide 15 slidably engaging at least one second slider 16. The second slider carries at least one second threading tube 17 slidably engaging one respective second weft yarn 18 in the same manner as already said with reference to the first slider 10. The second slider 16 too is subjected to the action of said horizontal-movement 13 and vertical-movement means 14 so that the corresponding threading tube 17 will perform a reciprocating motion following a trajectory substantially straddling the row formed by needles 5.

However, movement of the second slider 16 and the respective threading tube 17 is offset with respect to the cyclic movement of the first slider 10 substantially by a half-cycle, being intended that the term "cycle" means a complete going and return stroke (backwards and forwards stroke) performed by each slider 10, 16 along the corresponding weft-inserting guide 9, 15.

In more detail, the vertical-movement means 14 and horizontal-movement means 13 act on sliders 10, 16 in such a manner that their movement frequency as compared with the movement frequency of needles 5 corresponds to ¼, or it is in any case expressed by a fraction having as the denominator a number equal to twice the overall number of the weft-inserting guides 9, 15.

It is intended that the movement of each slider 10, 16 consists of cycles each comprising two vertical going strokes and two vertical return strokes, and one horizontal going and return stroke.

It is also to note that each movement cycle of needles 5 consists of one outgoing and one incoming stroke with respect to the front bar 4.

In this manner, laying down of the first and second weft yarns 12, 18 takes place following an alternated sequence. Each time one of the threading tubes 11, 17, at the end of the going or return stroke of the respective slider 10, 16 along the weft-inserting guide 9, 15, finishes laying down the respective weft yarn 12, 18, a chain-stitch-formation cycle is operated by a going and return stroke of needles 5 in cooperation with the respective eye-pointed needles 6. The laid down weft yarn (the first weft yarn 12 for example) is consequently interlooped in the chain stitches 6*b* formed by the warp yarns 6*a* while laying down of the other weft yarn 18 is taking place by means of the respective threading tube 17 which is substantially at an intermediate point of its horizontal-movement stroke.

As a result in comparison with the known art, in the present invention the operating speed of the individual threading tubes 11, 17 is halved, while the operating speed of the needles 5 and eye-pointed needles 6 is the same as in the known art, productivity too being consequently the same.

In order to conveniently operate sliders 10, 16 and the respective weft-inserting guides 9, 15, in the embodiment shown the vertical-movement means 14 essentially comprises a pair of lifting connecting-rods 19 each of which is connected to the respectively opposite ends of at least one of the weft-inserting guides 9, 15. The lifting connecting-rods 19 are operatively connected to respective eccentrics 20 mounted to side shafts 21 each of which is operatively housed in one of the crochet galloon machine standards 3*a*, 3*b*. The side shafts 21 are connected, by bevel gears 20*a* for example, to the drive shaft 22 intended for the reciprocating motion of needles 5.

In the embodiment shown, the transmission ratio between the drive shaft 22 and side shafts 21 is 2:1. In other words, the side shafts 21 rotate at a halved speed as compared with the rotation of the drive shaft 22, so that the vertical reciprocating oscillation transmitted by the lifting connecting-rods 19 has a halved frequency with respect to the reciprocating motion frequency of needles 5.

In a preferential solution, to be in particular adopted when the provided weft-inserting guides 9, 15 are two (as in the example shown) or a multiple of two each of the lifting connecting-rods 19 transmits a reciprocating motion to two of said weft-inserting guides 9, 15, through at least one rocking lever 23 having its fulcrum on a support 23*a* integral with the respective standard 3*a*, 3*b*. The rocking lever 23 engages the weft-inserting guides 9, 15 at respectively opposite parts from its fulcrum. In the embodiment shown two pairs of respective rocking levers 23 are associated with each lifting connecting-rod 19 and they are interconnected with the weft-inserting guides 9, 15 so as to form therewith a kinematic driving mechanism consisting of a four-bar linkage.

The horizontal-movement means 13, for each weft-inserting guide 9, 15 comprises a driving connecting-rod-crank mechanism 24 in which the crank 24*a* is operatively associated with an auxiliary shaft 25 in turn connected to the drive shaft 22 in a transmission ratio of 4:1. In other words, in order to make the shaft 25 perform a complete revolution, and therefore transmit a going translation and a return translation to the corresponding slider 10, 16, four complete revolutions of the drive shaft 22, and therefore four stitch-formation cycles carried out by the needles 5 and eye-pointed needles 6, are required. In the embodiment shown interconnection between the auxiliary shafts 25 and the drive shaft 22 occurs through one of the side shafts 21, by means of gear wheels 25*a* or equivalent transmission means.

Each driving connecting-rod-crank mechanism 24 (only one of which is shown in FIG. 1) is operatively interconnected with the respective weft-inserting slider 10, 16 through an intermediate leverage comprising an arm 26*a* pivotally mounted to the bed 3 and submitted to the action of the connecting-rod 24*b*, as well as a rod 26*b* connecting the arm 26*a* to the corresponding weft-inserting slider 10, 16.

Preferably, the device 1 further comprises holding means 27 operating close to the opposite ends of the row formed by needles 5 to conveniently hold the individual weft yarns 12, 18 at the end-of-stroke transitions of the corresponding sliders 10, 16. In other words, the holding means 27 is adapted to intervene by turns on each weft yarn 12, 18 (on the first weft yarn 12, for example) and engage it close to the end-of-stroke point of the corresponding slider 10, 16, to retain it at a position slightly raised above the needles 5 at least till when said needles are moved forward towards the eye-pointed needles 6 to give rise to the formation of a stitch interlooping the length of the weft yarn 12, 18 (the second weft yarn 18, for example) that had been previously laid down by the threading tube 11, 17 belonging to the other weft-inserting guide 9, 15 (the second weft-inserting guide 15, for example).

To this end, the holding means 27 is comprised of hook-shaped elements 28*a*, 28*b*, 29*a*, 29*b* positioned before the front bar 4 close to the opposite ends of the row formed by needles 5, and controlled by respective reciprocating-movement means 30 imparting a reciprocating motion towards the front bar 4 to said hook-shaped elements. More particularly, in the embodiment shown provision is made for two inner hook-shaped elements 28*a*, 28*b* and two outer hook-shaped elements 29*a*, 29*b*, each of which lends itself to cyclically hold a respective one of the weft yarns 12, 18.

Figure 8:
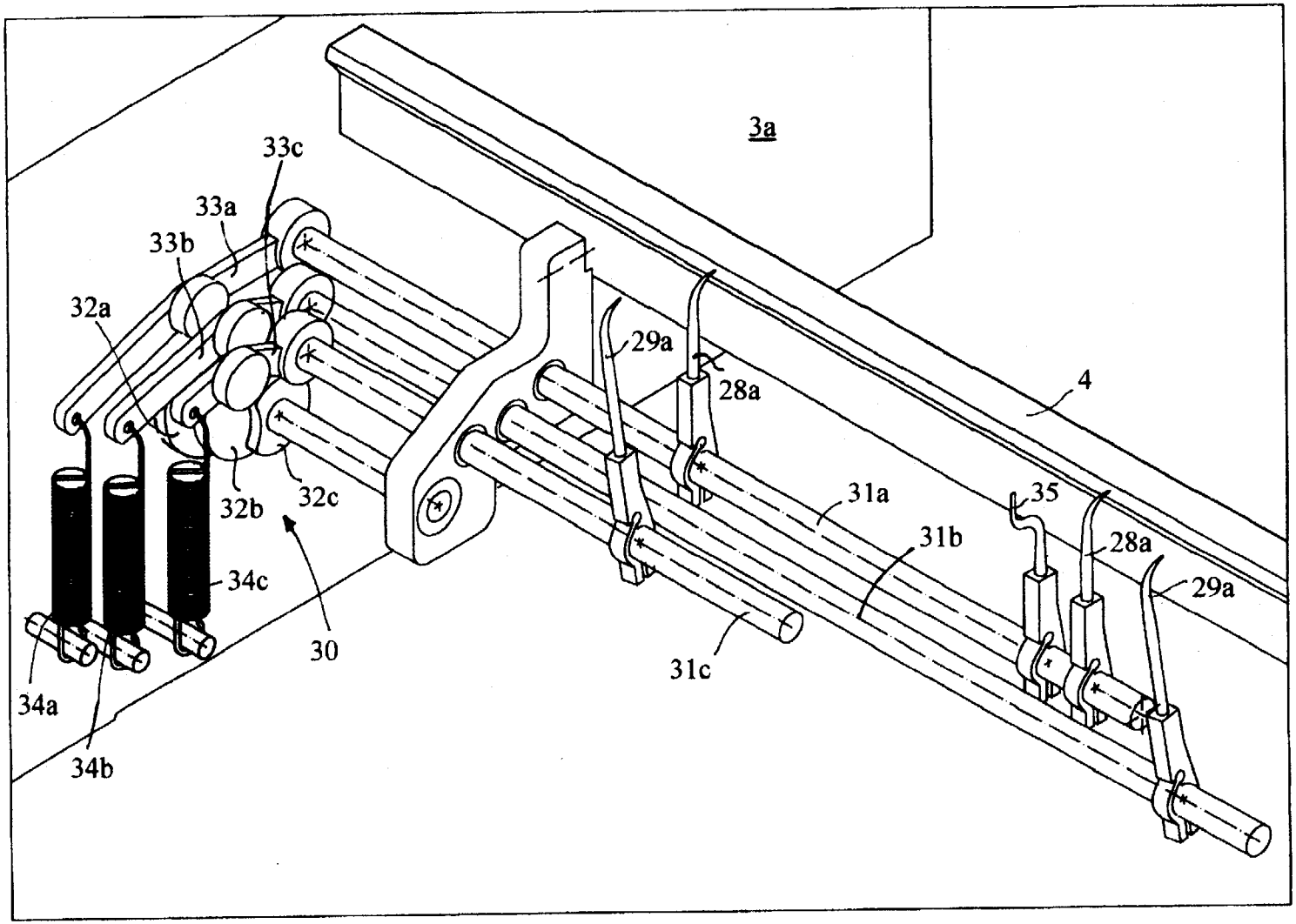
FIG. 8 is a perspective view highlighting the movement means of the hook-shaped elements as arranged in the described embodiment of the device in question.

As shown in FIG. 8, the reciprocating-movement means 30 essentially comprises two or more support stems 31*a*, 31*b*, 31*c*, each of which carries at least one corresponding hook-shaped element 28*a*, 28*b*, 29*a*, 29*b* and extends parallelly to the front bar 4. Each support stem 31*a*, 31*b*, 31*c* is operated with a reciprocating motion about its own axis by a respective cam 32*a*, 32*b*, 32*c* acting on a lever 33*a*, 33*b*, 33*c* against the action of spring means 34*a*, 34*b*, 34*c*. Said cams are set in rotation at a speed corresponding to half the rotation speed of the drive shaft 22. To this end, a pair of gears or equivalent means, not shown, may be provided and they are adapted to transmit rotation of one of the side shafts 21 to cams 32*a*, 32*b*, 32*c*.

As shown in FIG. 8, one or more support stems 31*a*, 31*b*, 31*c* can be utilized to support a thin plate element 35 arranged to be fitted between the warp yarns 6*a* located at one end of the needle row to conveniently hold them and counteract possible stresses transmitted by the weft yarns 12, 18 being about to be laid down.

With reference to FIGS. 2 to 7, the operating cycle of a crochet galloon machine provided with the device of the present invention is now described for explanatory purposes.

For the sake of clarity and simplicity, in said figures insertion or laying down of the weft yarn 12 alone combined with the first slider 10 is shown.

Figure 2B:
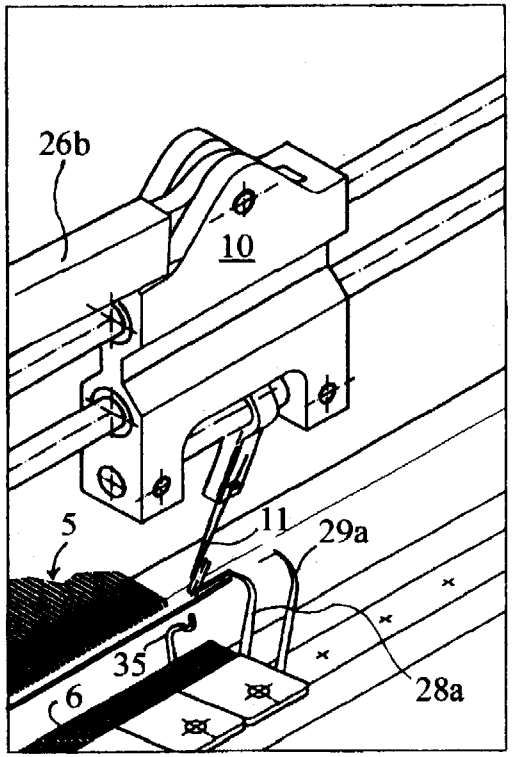
FIGS. 2*a* and 2*b* show two operating steps of a first weft-inserting slider close to reversal of its horizontal movement at the end-of-stroke point to the right of needles.
Figure 2A:
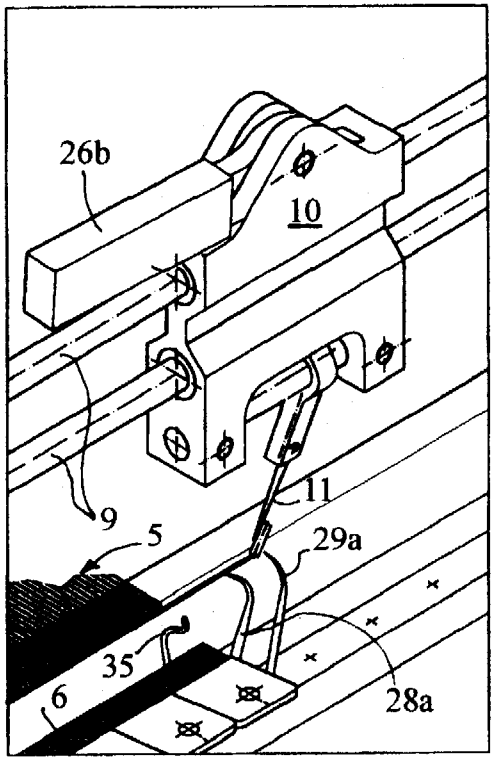
Figure 2:
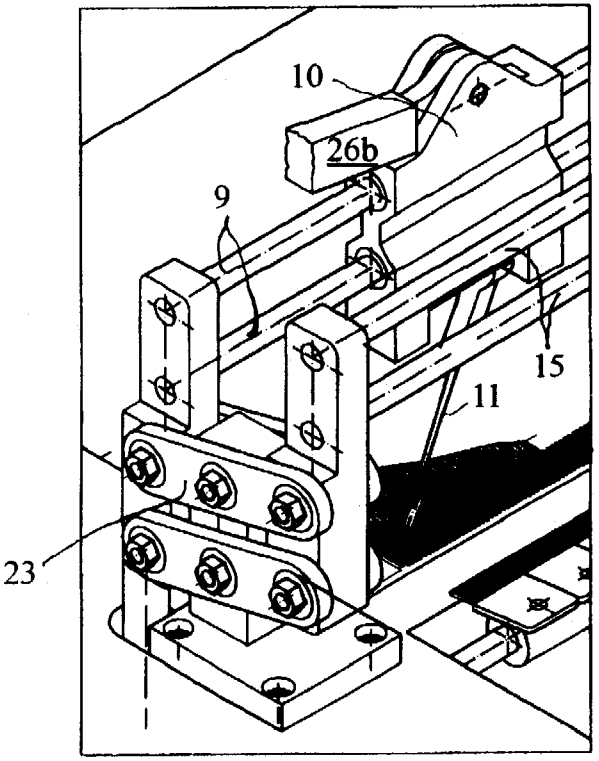
FIG. 2 illustrates the positioning substantially taken by the vertical-movement means in the operating steps of the device shown in FIGS. 2*a* and 2*b*, respectively.

In the operating step in FIG. 2*a* the threading tube 11 is about to come close to the right dead point of its reciprocating motion. During its movement to the right the threading tube 11 has laid down its weft yarn 12 before the needles 5. When the threading tube has come close to the right end-of-stroke, the lifting connecting-rods 19 have brought the first weft-inserting guide 9 to a lowered position (FIG. 2), so that the weft yarn 12 laid down by the threading tube 11 is disposed slightly under the needles 5.

Immediately after the step shown in FIG. 2*a*, the needles 5 follow a reciprocating-movement cycle towards the eye-pointed needles 6 forming a chain stitch in which the weft yarn 12 is interlooped.

Concurrently with the operating cycles carried out by the needles, movement reversal of the first slider 10 along the weft-inserting guide 9 occurs. FIG. 2*b* highlights the fact that, concurrently with movement reversal of said slider 10, the inner hook 28*a* located at the right end-of-stroke has engaged the weft yarn 12.

During the movement reversal, the lifting connecting-rods 19 have started raising the first weft-inserting guide 9, so that the threading tube 11 is subjected to pass over the inner hook 28*a* giving rise to engagement of the weft yarn 12 thereon.

Figure 3A:
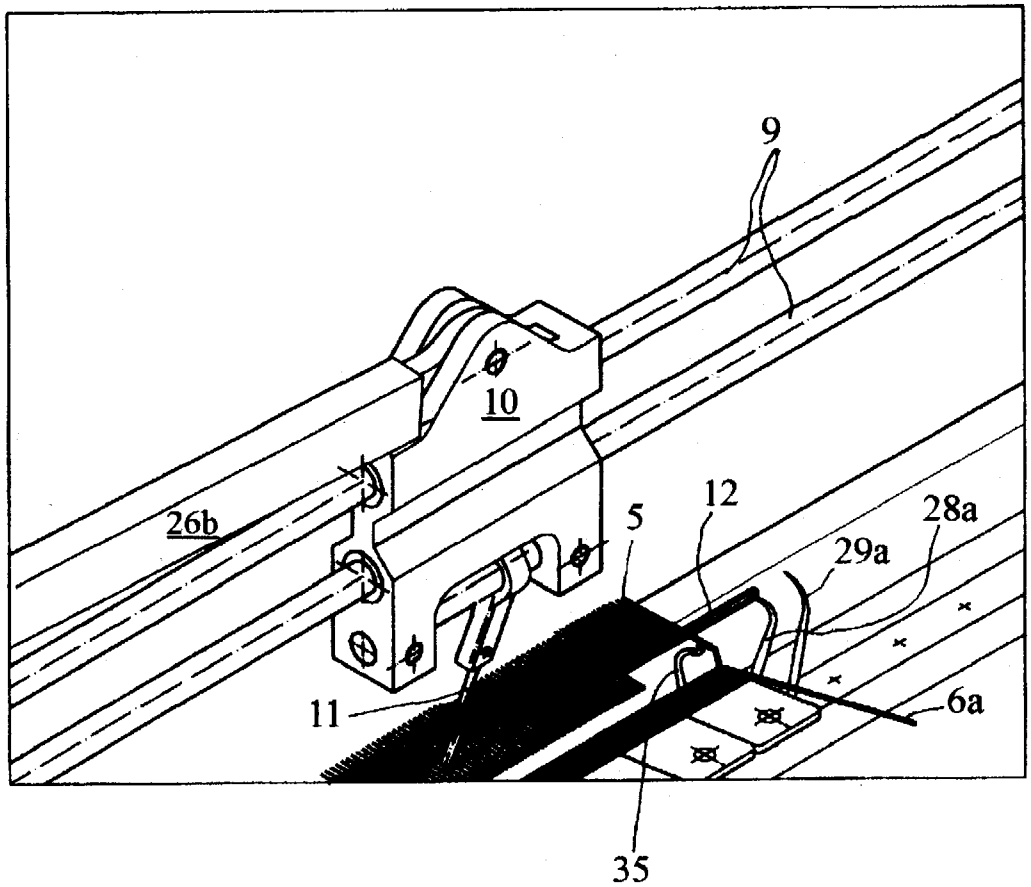
FIG. 3*a* shows an operating step in which the first weft-inserting slider is moving away from the right end-of-stroke, while the corresponding rear weft yarn is held up by a hook-shaped element arranged to the right of the needles.
Figure 3:
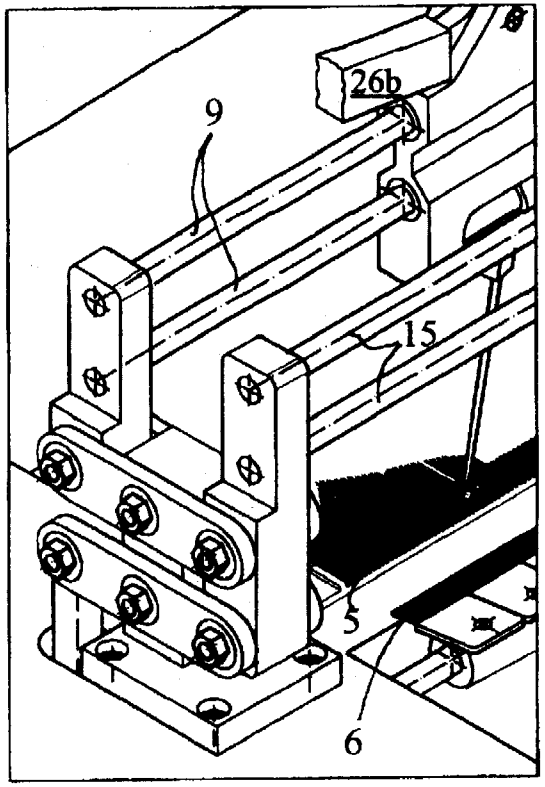
FIG. 3 illustrates a positioning of the vertical-movement means in the operating step shown in FIG. 3*a*.
Figure 3B:
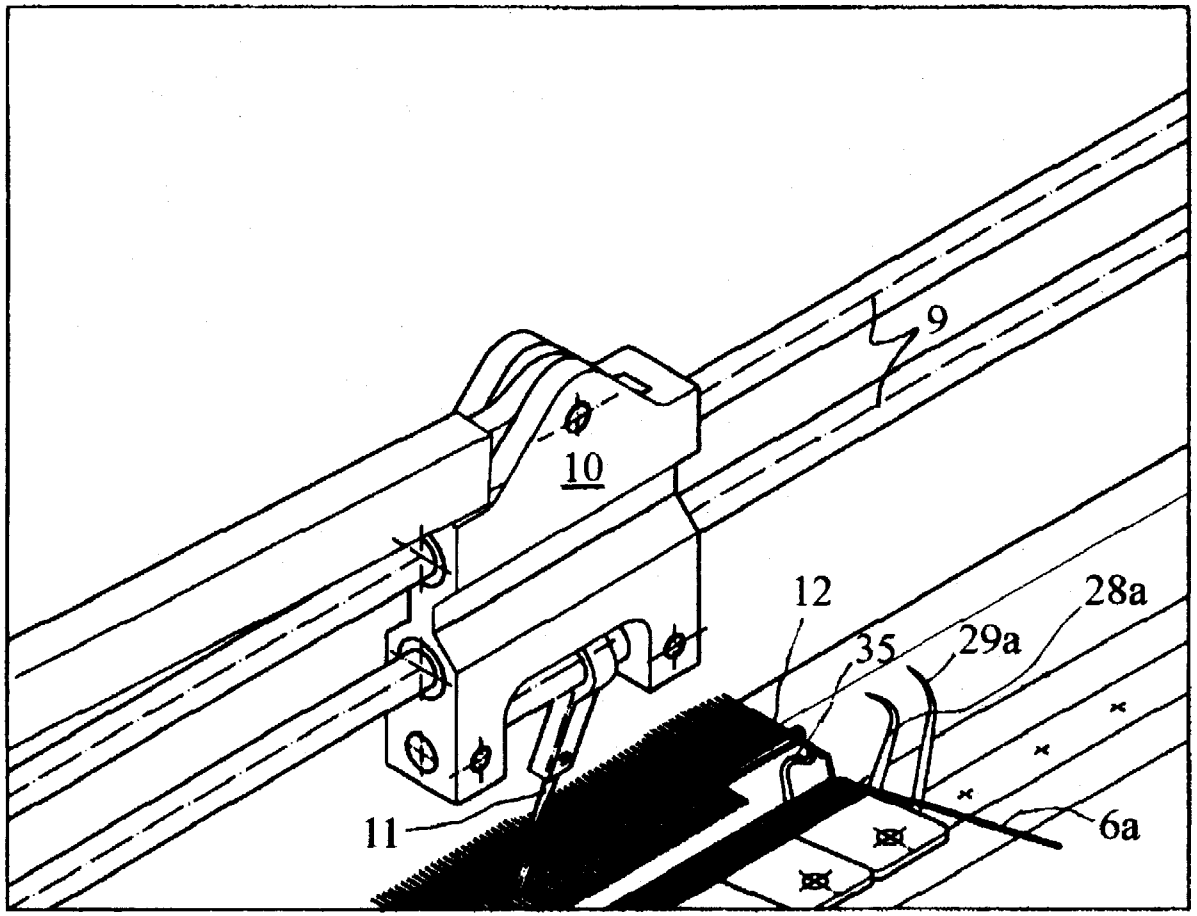
FIG. 3*b* shows the first weft-inserting slider during a step immediately following the one shown in FIG. 3*a*, in which the weft yarn carried by the rear threading tube has been disengaged from the respective hook-shaped element.

Raising of the first weft-inserting guide 9 goes on by the forward movement of slider 10 directed away from the right dead point of its horizontal movement. Thus the threading tube 11 is capable of passing over the needles 5, while said needles, as shown in FIG. 3*a*, move close to the eye-pointed needles 6 again, to start formation of a new stitch in which there will be interlooping of the length of the second weft yarn 18 laid down by the second threading tube 17 which is about to come close to its left end-of-stroke. As can be viewed from FIG. 3*b*, when the needles 5 are at a forward or advanced position, the inner hook-shaped element 28*a* is moved backward from the front bar 4, to release the weft yarn 12 that, as moving forward of the slider 10 goes on, is brought against the needle 5 located at the row end.

During this step also raising of the first guide 9 by the connecting-rods 19 (FIG. 3) goes on.

Figure 4A:
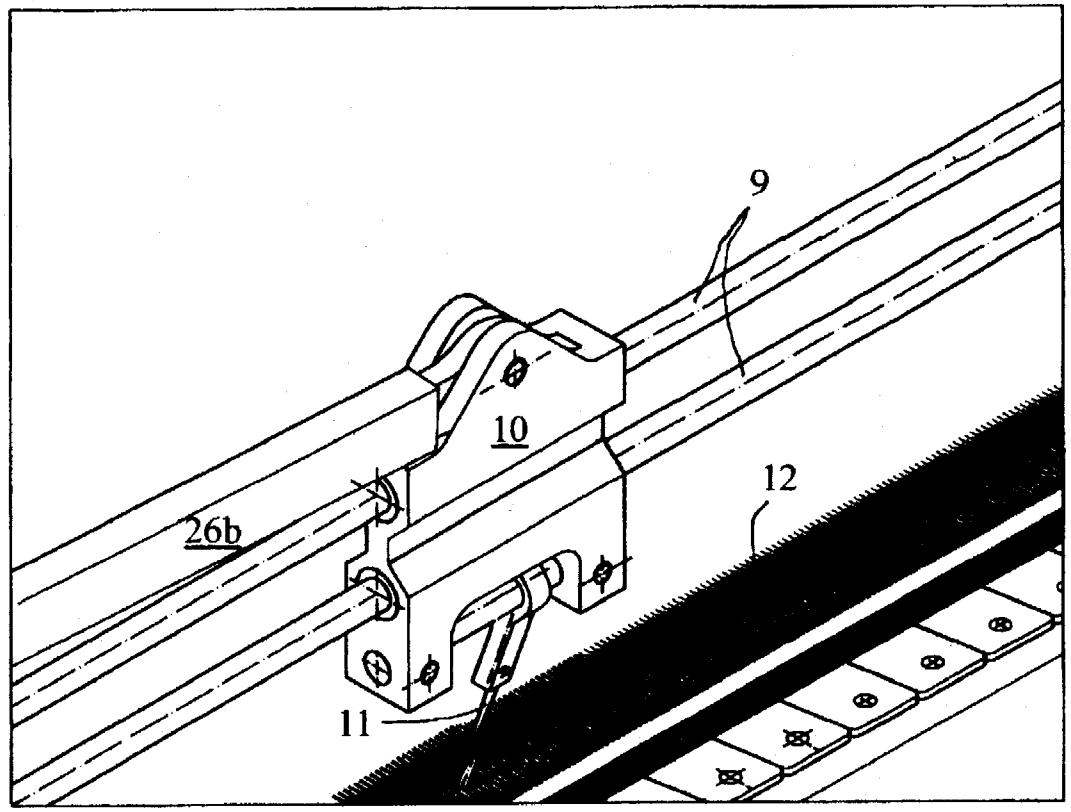
FIG. 4*a* shows the first weft-inserting slider during an operating step in which the threading tube is moved over the needles.
Figure 4:
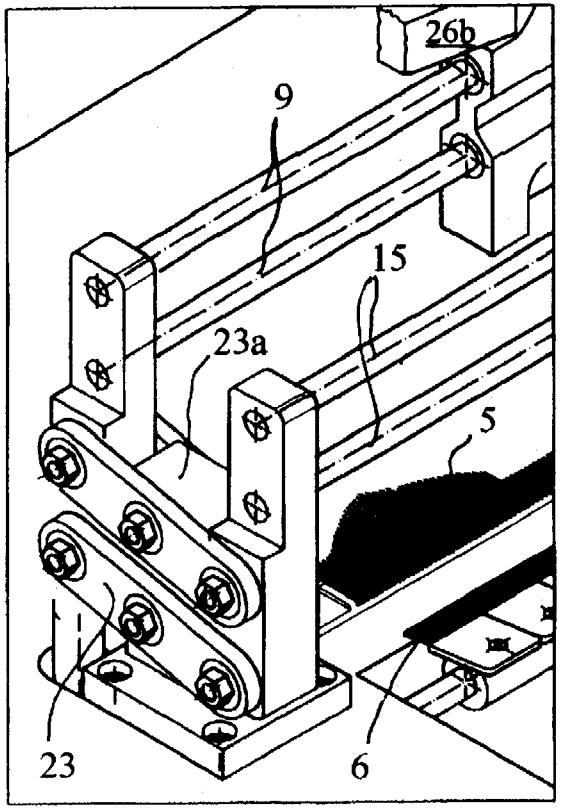
FIG. 4 shows a positioning taken by the vertical-movement means during the operating step referred to in FIG. 4*a*.

Shown in FIGS. 4 and 4*a* is the maximum elevation reached by the first weft-inserting guide 9 while the first threading tube 11 is at an intermediate point of the needle row length. During this step, the second weft-inserting guide 15 is completely lowered whereas the second threading tube 17 has reached its left end-of-stroke to enable the second weft yarn 18 laid down by the second threading tube to be interlooped into the chain stitches 6*b* formed as a result of the subsequent backward movement of needles 5.

When the first threading tube 12 comes close to the left end-of-stroke, the lifting connecting-rods 19 will complete a new lowering of the first weft-inserting guide 9 (FIG. 5*a*) so that the new length of the weft yarn 12 laid down on needles 5 passes under said needles.

During this step, the second threading tube 17 associated with the second (completely raised) weft-inserting guide 15 is moving along the needle 5 row at a higher level than the needles themselves. Concurrently with this step, needles 5 perform a going and return cycle with respect to the eye-pointed needles 6 to interloop the new length of weft yarn 12 laid down by the first threading tube 11.

Figure 5B:
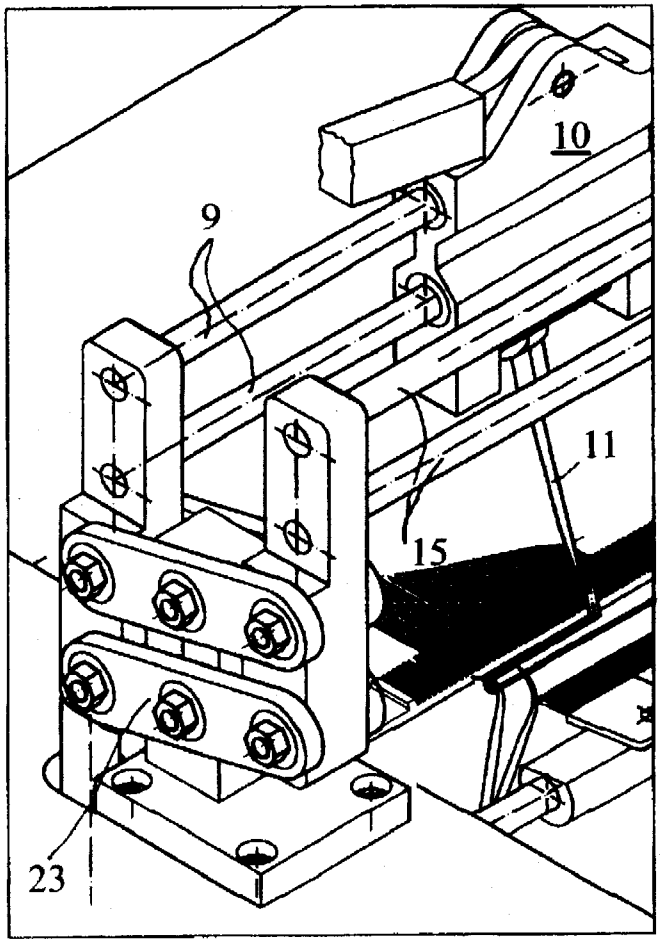
FIGS. 5*a* and 5*b* show two steps immediately following reversal of the horizontal movement by the first weft-inserting slider close to the left dead point of its stroke.
Figure 5A:
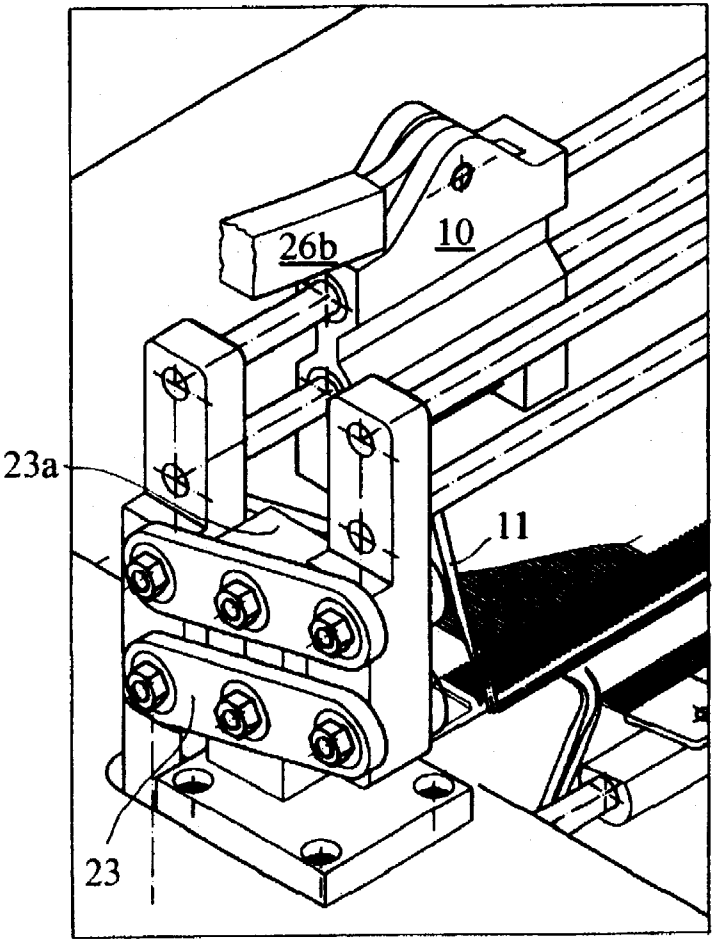
Figure 7:
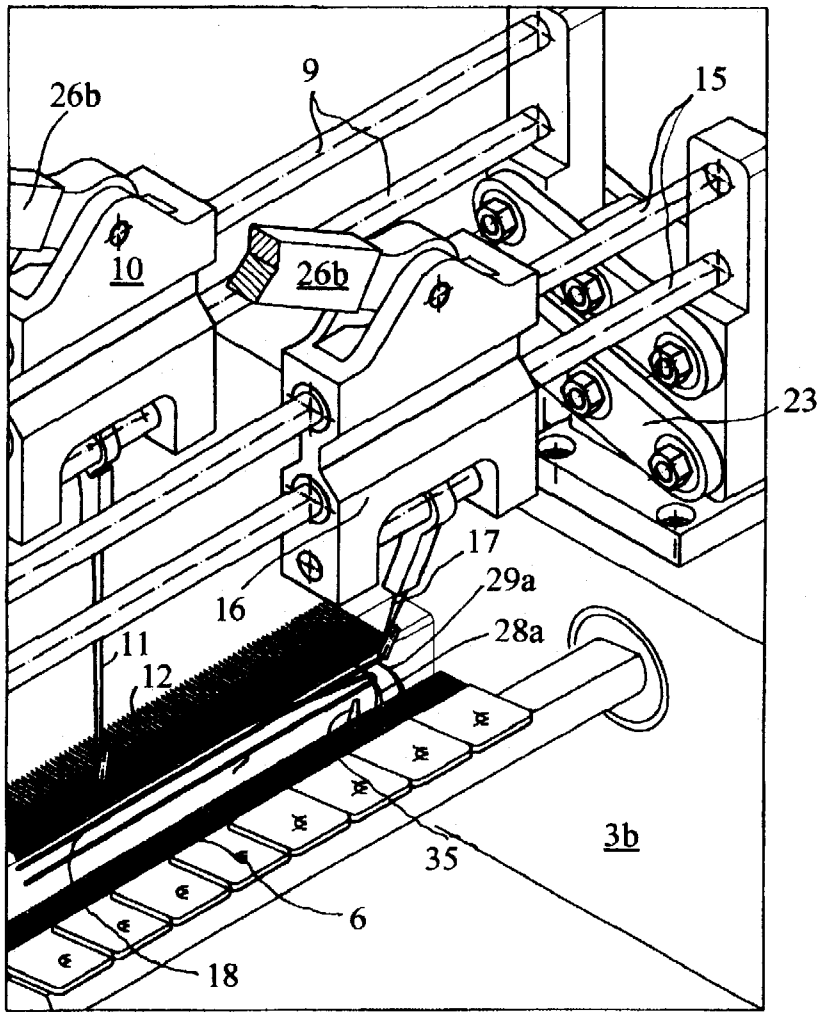
FIG. 7 represents an operating situation similar to the one in FIG. 6, at the right dead point of the sliders' horizontal movement.
Figure 6:
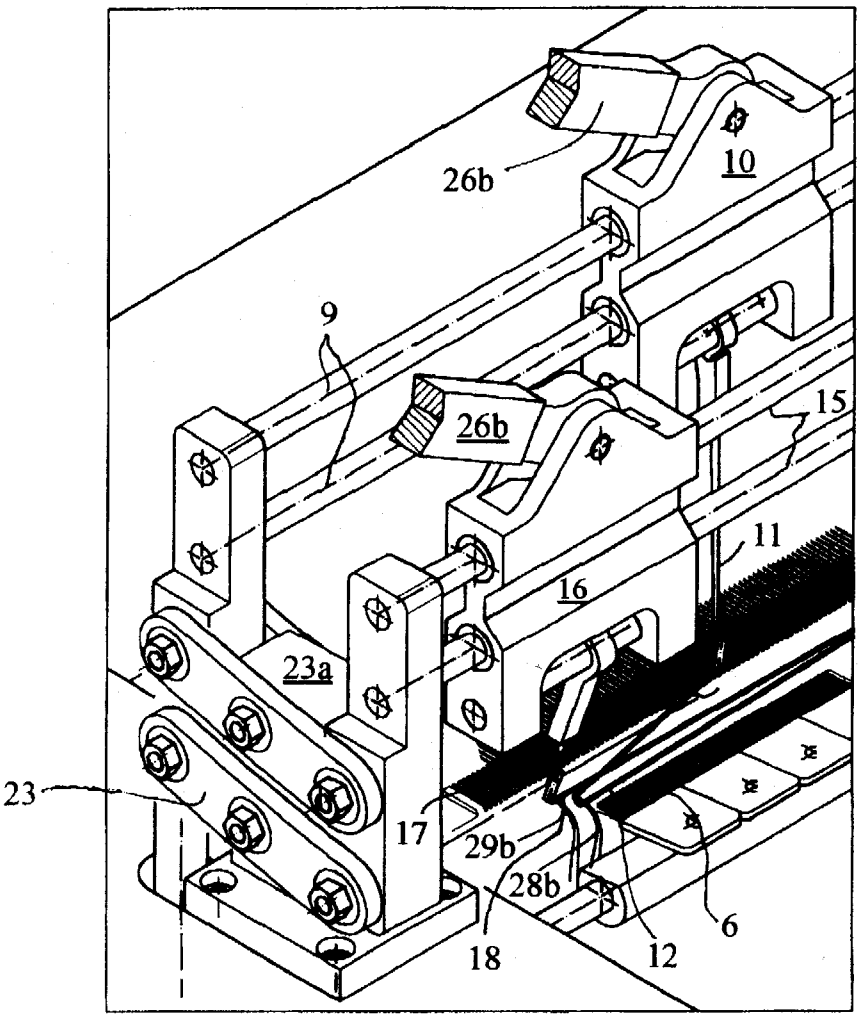
FIG. 6 shows both weft-inserting sliders during an operating step in which a forward-disposed second slider is moving close to the dead point of a left stroke, whereas the first slider is moving away from the same dead point.

Shown in FIG. 5*b* is the beginning of a new stroke of the first threading tube 11 away from the left dead point. During this step the lifting connecting-rods 19 have started raising of the first weft-inserting guide 9, thus enabling the threading tube 11 to step over the left outer hook 29*a* holding the weft yarn 12.

The movement cycle of the first slider 10 is completed when it reaches its right end-of-stroke again in the same manner as described with reference to the movement of same to the left end-of-stroke.

Figure 9:
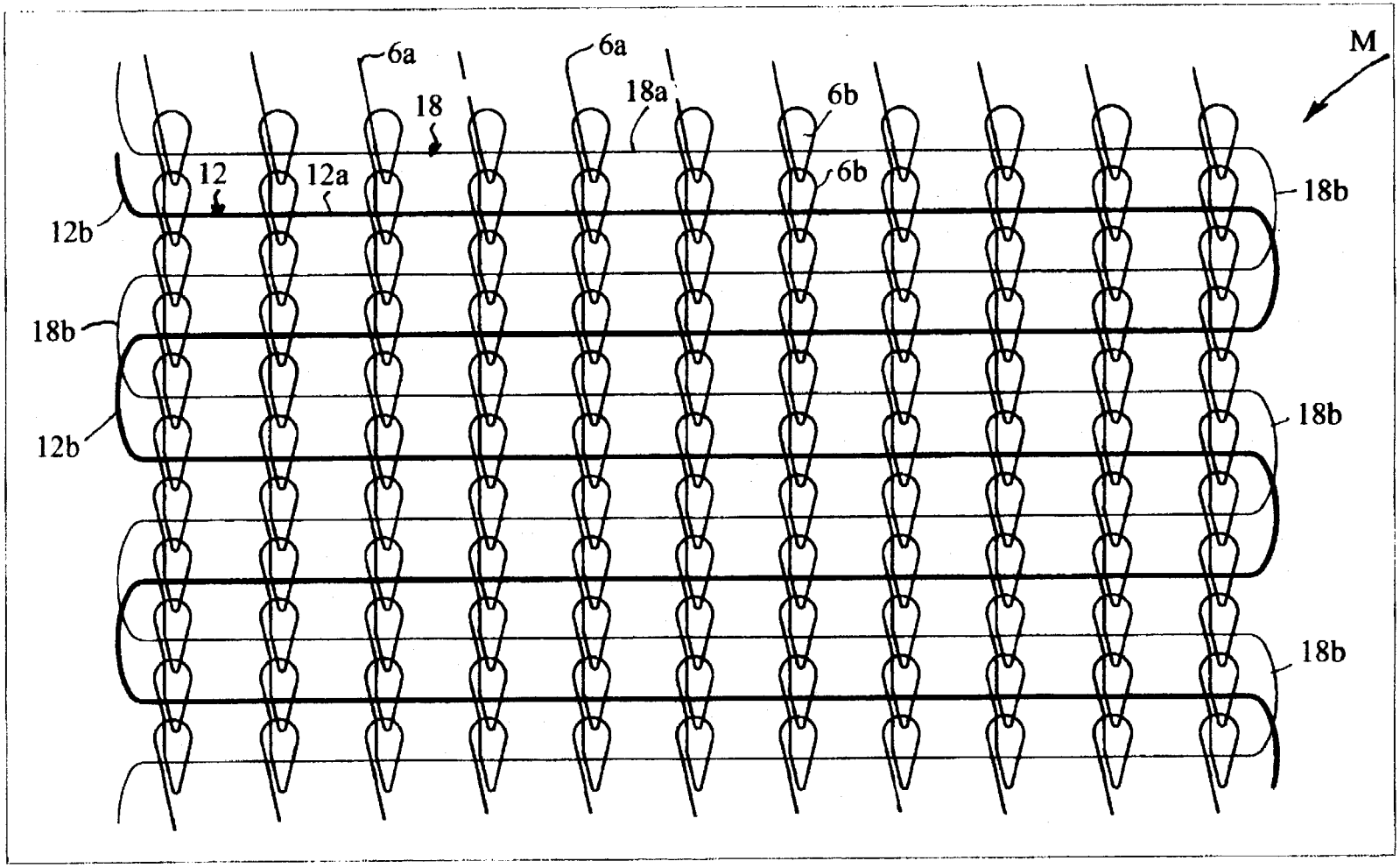
FIG. 9 diagrammatically shows an article of manufacture made with the aid of the device in accordance with the invention.

The alternated interlooping of the first and second weft yarns 12, 18 following the above described mode gives rise to an article of manufacture "M" the essential features of which can be deduced from the pattern shown in FIG. 9.

This article of manufacture M is characterized in that it comprises two or more weft yarns 12, 18, each of which extends in main parallel lengths 12*a*, 18*a* sequentially alternating with the main lengths of the other weft yarn or yarns. The main lengths 12*a*, 18*a* of each weft yarn 12, 18 are consecutively connected with each other by union lengths 12*b*, 18*b* alternately-interposed on the opposite ends of the article of manufacture "M" and each of them extending astride the union length of the other weft yarn.

The present invention achieves the intended purposes.

By adopting two weft-inserting sliders mounted on respective weft-inserting guides and carrying respective threading tubes, a drastic reduction in the operating speed of the sliders is in fact possible, the operating speed of the needles 5 and the crochet galloon machine in general remaining unchanged.

Practically, by the previously illustrated solution it is potentially possible to achieve doubling of the crochet galloon machine productivity.

Therefore the invention enables elimination of the productivity limits induced in the known art by the use of the weft-inserting devices mounted on the crochet galloon machines of the described type.

It is to note that the invention is not limited to the use of two weft-inserting sliders as in the described embodiment. It is in fact possible to use three or more sliders mounted on respective weft-inserting bars to reduce, depending on requirements, the operating speed of the sliders while keeping productivity unchanged or, conversely, to increase productivity while keeping the average speed of the sliders unchanged.

By arranging gear wheels or equivalent means having appropriate transmission ratios, depending on the number of weft-inserting guides used, movement from the drive shaft 22 or an equivalent drive means can be transmitted to the different members of the device 1 in such a manner that the horizontal and vertical movement of each slider is in any case offset with respect to that of the other sliders by a cycle fraction the denominator of which corresponds to the overall number of the installed weft-inserting guides. For example, if three weft-inserting guides with the respective sliders are used, movements of the individual sliders will be mutually offset by one third of a cycle; if four weft-inserting guides are used, the slider movement will be offset by one fourth of a cycle and so on.

Consequently, the rotation speed of the side shafts 21 and cams 32*a*, 32*b* and 32*c* for control of the hook-shaped elements 28*a*, 28*b*, 29*a*, 29*b* will be correlated with the operating speed of the drive shaft 22 according to fraction the denominator of which corresponds to the number of the installed weft-corresponds inserting guides. Likewise, the rotation speed of the auxiliary shafts 25 will be correlated with the operating speed of the drive shaft 22 according to a fraction the divisor of which will correspond to twice the number of the weft-inserting guides.

Obviously the crochet galloon machine can be equipped, in addition to the device in reference, with usual carrier slide bars adapted to insert auxiliary yarns extending parallelly to the chains made by the warp yarns and/or according to a predetermined path between two or more contiguous chains.

What is claimed is:

1. A device for inserting alternately-interposed wefts on a crochet galloon machine for warp weaving, said machine having a plurality of needles (5) carrying out a reciprocating motion in a substantially rectilinear direction on a front bar (4) and guide eye-pointed needles (6) disposed before the needles (5) and each moved in a circular trajectory extending about the movement trajectory of a corresponding needle (5), said device comprising:

at least one first weft-inserting guide. (9) extending horizontally above the needles (5) at right angles to the movement direction of the needles themselves;

at least one first weft-inserting slider (10) slidably engaged along the weft-inserting guide (9) and carrying at least one first threading tube (11) arranged to engage at least one first weft yarn (12);

at least one second weft-inserting guide (15) extending above the needles (5) parallelly to the first weft-inserting guide (9);

at least one second weft-inserting slider (16) slidably engaged along the second weft-inserting guide (15) and carrying at least one second threading tube (17) arranged to engage at least one second weft yarn (18);

horizontal-movement means (13) acting on the weft-inserting sliders (10) to drive them with a reciprocating motion along the first weft-inserting guide (9);

vertical-movement means (14) to transmit a reciprocating oscillatory motion in a vertical direction to the weft-inserting sliders (10); wherein:

said vertical-movement means (14) and horizontal-movement means (13) act on said sliders (10, 16) to operate them with mutually offset periodical reciprocating motions the frequency of which, with respect to the movement frequency of the needles (5), is a fraction having as the denominator a value which is twice the overall number of said weft-inserting guides (9, 15).

2. The device as claimed in claim 1, comprising holding means (27) operating close to the opposite ends of a row formed by said needles (5), in order to retain the weft yarns (12, 18) at the end-of-stroke transitions of the respective weft-inserting sliders (10, 16).

3. The device as claimed in claim 2, wherein said holding means (27) is arranged to retain at least the first weft yarn (12, 18) at a position slightly raised above the needles (5) when the needles themselves move forward towards the eye-pointed needles (6) so as to form a stitch (6*b*) adapted to interloop said at least one second weft yarn (12, 18) previously laid down.

4. The device as claimed in claim 2, wherein said holding means (27) comprises: hook-shaped elements (28*a*, 28*b*, 29*a*, 29*b*) positioned before the front bar (4) of the crochet galloon machine and close to the ends of the row formed by needles (5); reciprocating-movement means (30) operating on said hook-shaped elements (28*a*, 28*b*, 29*a*, 29*b*) for imparting an oscillatory motion to said elements in the direction of the front bar (4).

5. The device as claimed in claim 2, wherein at each end of the row formed by needles (5), provision is made for an inner hook-shaped element (28*a*, 28*b*) and an outer hook-shaped element (29*a*, 29*b*), each of which is intended for retaining a respective weft yarn (12, 18).

6. The device as claimed in claim 2 wherein said reciprocating-movement means (30) comprises a plurality of support stems (31*a*, 31*b*, 31*c*) each of which carries at least one of said hook-shaped elements (28*a*, 28*b*, 29*a*, 29*b*) and is operated with an angular oscillatory motion about its own axis by a respective cam (32*a*, 32*b*, 32*c*) rotating at a speed correlated with the operating speed of a drive shaft (22) for movement of the crochet galloon machine needles (5), according to a fraction the denominator of which corresponds to the number of the installed weft-inserting guides (9, 15).

7. The device as claimed in claim 1, wherein said horizontal-movement means (13) comprises, for each weft-inserting guide (9, 15), a driving connecting-rod-crank mechanism (24) operatively interconnected with said weft-inserting slider (10, 16) and driven by at least one auxiliary shaft (25) rotating at a speed correlated with the operating speed of a drive shaft (22) for movement of the crochet galloon machine needles (5), according to a fraction the divisor of which corresponds to twice the number of the installed weft-inserting guides (9, 15).

8. The device as claimed in claim 1, wherein said vertical-movement means (14) comprises at least one pair of lifting connecting-rods (19) each of which is connected to the respectively opposite ends of at least one of said weft-inserting guides (9, 15), said lifting connecting-rods (19) being operatively connected with respective eccentrics (20) mounted to side shafts (21) rotating at a speed correlated with the operating speed of a drive shaft (22) for movement of the crochet galloon machine needles (5), according to a fraction the corresponding divisor of which corresponds to the number of installed weft-inserting guides (9, 15).

9. The device as claimed in claim 8, wherein each of said lifting connecting-rods (19) is connected with two of said weft-inserting guides (9, 15) by at least one rocking lever (23) engaging the weft-inserting guides on respectively opposite sides from its fulcrum.

* * * * *